United States Patent [19]

Klubitschko

[11] Patent Number: 4,563,021

[45] Date of Patent: Jan. 7, 1986

[54] RELEASE MECHANISM FOR SAFETY SKI BINDINGS

[75] Inventor: Gerd Klubitschko, Oberau, Fed. Rep. of Germany

[73] Assignee: Marker International Company, Salt Lake City, Utah

[21] Appl. No.: 495,341

[22] PCT Filed: Aug. 17, 1982

[86] PCT No.: PCT/EP82/00175

§ 371 Date: Apr. 15, 1983

§ 102(e) Date: Apr. 15, 1983

[87] PCT Pub. No.: WO83/00633

PCT Pub. Date: Mar. 3, 1983

[30] Foreign Application Priority Data

Aug. 17, 1981 [DE] Fed. Rep. of Germany ..... 3132465

[51] Int. Cl.[4] ..... A63C 9/086

[52] U.S. Cl. ..... 280/612

[58] Field of Search ..... 280/612, 611, 631, 632, 280/618

[56] References Cited

U.S. PATENT DOCUMENTS

| | | | |
|---|---|---|---|
| 3,762,735 | 10/1973 | Smolka | 280/612 |
| 3,940,156 | 2/1976 | Marker | 280/612 |
| 4,130,296 | 12/1978 | D'Antonio et al. | 280/612 |
| 4,230,338 | 10/1980 | Weigl | 280/618 |
| 4,291,894 | 9/1981 | D'Antonio et al. | 280/612 |
| 4,494,767 | 1/1985 | Campillo | 280/612 |

FOREIGN PATENT DOCUMENTS

| | | | |
|---|---|---|---|
| 2757800 | 7/1978 | Fed. Rep. of Germany | 280/612 |
| P31281850 | 7/1981 | Fed. Rep. of Germany . | |
| 2109799 | 5/1972 | France | 280/612 |
| 2418655 | 9/1979 | France | 280/612 |

*Primary Examiner*—Joseph F. Peters, Jr.
*Assistant Examiner*—Everett G. Diederiks, Jr.
*Attorney, Agent, or Firm*—D. Peter Hochberg

[57] ABSTRACT

A release mechanism for safety ski bindings activated by a magnetic release system and movable between a cocked and a release condition. In its release condition, the mechanism releases a ski binding from a closed to an open condition. The mechanism has a holding lever movable between a holding and a releasing position, with the holding lever abutting a connecting lever which, along with a handle lever and a release lever, forms a spring retaining mechanism. The release lever is spring biased from a cocked to a releasing condition.

11 Claims, 3 Drawing Figures

RELEASE MECHANISM FOR SAFETY SKI BINDINGS

BACKGROUND OF THE INVENTION

This invention relates to a release mechanism for safety ski bindings for amplifying the releasing force of a magnetic release system to a level sufficient to achieve release of a safety ski binding from a closed position to an open position, thus disengaging a ski boot from the ski.

For a skier's optimum safety and convenience, it is important that, while skiing, each ski boot is rigidly fixed with respect to the ski. On the other hand, in the event of an imminent fall it is important that the ski boot be disengaged from the ski to minimize possible injury to the skier. To achieve these goals, a wide variety of safety ski bindings have been developed for releasing a ski boot from a ski when the forces on the ski exceed a predetermined value.

Many ski bindings are entirely mechanical in nature. These mechanical bindings, while useful, tend to be somewhat unpredictable. Although the binding may be set to release when a predetermined force is applied, ice, snow, and dust may interfere with the binding's operation. Also, mechanical bindings often utilize mechanisms that latch the boot to the ski at the heel and toe of the boot. Such a binding detects only that component of applied force that acts on the heel or toe portion of the binding. This is adequate to achieve release when the skier falls either forward or backward, however, with twisting falls or with falls to the side, even though the total force may be sufficient to constitute a danger to the skier, the component of the force acting on the heel or toe of the binding may be insufficient to achieve release of the ski boot from the ski.

In recent years, electronic ski bindings have been proposed to overcome some of these disadvantages. Some of these bindings include sensors that detect not only the forces acting on the toe and heel portions of the ski boot, but additionally, the forces acting on the sides of the ski boot, such as occur with twisting falls or falls to the side. These sensors are designed to generate electrical signals when release is appropriate. Examples of such bindings are disclosed in U.S. Pat. No. 4,291,894 (D'Antonio, et al.), incorporated herein by reference.

While these improved ski bindings utilize an electronic system for detecting forces on the ski, the physical release of the ski boot generally involves a mechanical system. Thus, it is necessary to design electronic bindings so that the electrical signals will result in actuation of the mechanical ski boot release. To achieve this goal, an interface between the electronic and mechanical components of the ski binding is necessary. The interface must be activated by the electronic signals and, in turn, actuate the mechanical release system that controls physical release of the ski boot from the ski. Examples of such ski bindings are disclosed in U.S. Pat. No. 4,130,296 (D'Antonio, et al.), incorporated herein by reference. In that reference, a solenoid is utilized as an interface, while magnetic release systems for this use are proposed in earlier referenced U.S. Pat. No. 4,291,894.

An improved magnetic release system is disclosed in U.S. Pat. No. 4,484,761 (German Application No. P 31 28 185.0). This system utilizes a release arm with a small mass relative to the mass of a permanent magnet and an electromagnet. The arm is spring biased towards an actuating position and is held in a non-actuating position, against the spring force, by a magnetic field induced by the permanent magnet. When ski boot release is appropriate, an electrical impulse from the electronic component of the ski binding energizes the electromagnet, diminishing or cancelling the magnetic field induced by the permanent magnet. The release arm, no longer restrained in its non-actuating position by the magnetic field, moves under spring force to its actuating position in which the arm initiates ski boot release.

The above-described magnetic release system is advantageous for it is highly efficient with resulting low energy consumption; this, in part, because it is necessary only to diminish or cancel the magnetic field induced by a small permanent magnet, allowing spring force to move the release arm. Also, the system provides a reduced possibility of faulty release due to the small mass of the release arm relative to the mass of the permanent magnet and the electromagnet. A consequence of achieving these advantages is that the releasing force exerted by movement of the release arm from its nonactuating to its actuating position is relatively small; smaller, indeed, than the force necessary for releasing the ski binding from a closed to an open position. Thus, to achieve release of the ski binding and consequent release of a ski boot from the ski, it is necessary to enhance the force exerted by the release arm. This invention provides a convenient means of enhancing the releasing force of a magnetic release system.

SUMMARY OF THE INVENTION

This invention provides a release mechanism which functions as a force amplifier, movable between cocked and release conditions for translating the releasing force of a magnetic release system to a level sufficient to achieve release of a ski binding latching mechanism from its latching condition to its unlatching condition. In its unlatching position, the latching mechanism releases a ski binding from its closed to its open condition. A force amplifier according to this invention preferably comprises a holding means for holding the release mechanism in its cocked condition; the holding means movable between a holding and a releasing position. The holding means in its holding position restrains a retaining means in its retaining condition; wherein the retaining means retains a release means in its cocked position. A spring means biases the release means from a cocked to a releasing position.

Movement of the holding means to its releasing position results in movement of the retaining means to a releasing condition. The spring means then urges the release means from its cocked to its releasing position. Movement of the release means to its releasing position urges a latching means from a latching to an unlatching condition, releasing the ski binding from its closed to its open condition; thus, releasing the ski boot from the ski.

The spring means associated with a force amplifier according to this invention is stronger than the spring means associated with an efficient magnetic release system as above described; with the former spring means exerting a force sufficient to urge the latching means from a latching to an unlatching condition. With this construction, it is possible for the relatively small releasing force of an efficient magnetic release system to initiate mechanical release of a ski binding from a closed to an open condition.

DESCRIPTION OF THE PREFERRED EMBODIMENTS

Figure 1:
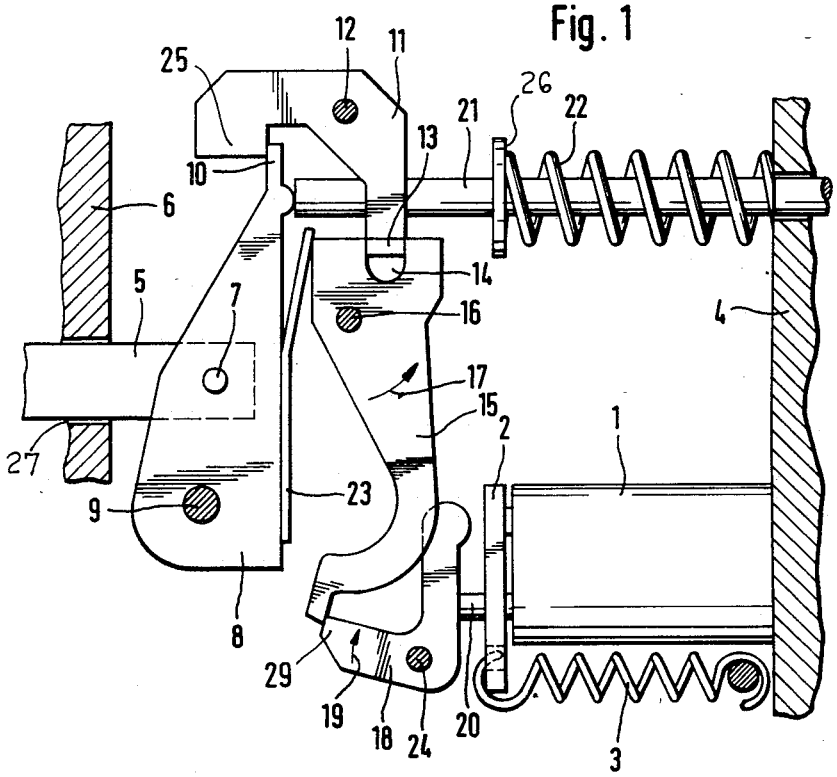
FIG. 1 A force amplifier according to this invention, in its cocked condition, showing a magnetic release system in its non-actuating position and a latching means in its latched condition.
Figure 2:
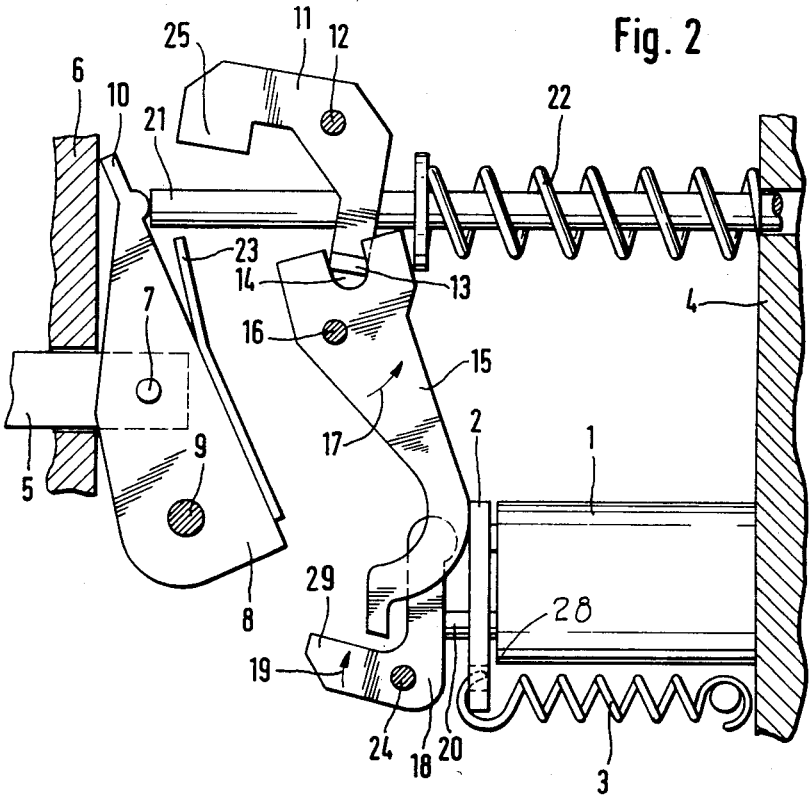
FIG. 2 A force amplifier according to this invention in its releasing position showing a latching means in its unlatching condition.

Turning to the drawings, FIG. 1 illustrates a preferred embodiment of a force enhancer according to this invention in its cocked condition as comprising a holding lever 18 pivotally mounted on an axle 24; said holding lever 18 biased in a clockwise direction, as shown by arrow 19, about axle 24 by a spring (not shown). (All references to directions such as clockwise, counterclockwise, left and right refer to directions as illustrated in FIG. 1 and FIG. 2). One arm of lever 18 contacts a stop 20 which is preferably a soft iron post associated with a magnetic release system. The magnetic release system is shown as comprising a magnet 1, a release arm 2, a release spring 3 and stop 20. Magnet 1 and spring 3 are mounted on a fixed part 4 of a safety ski binding (not shown). FIG. 1 illustrates release arm 2 in its non-actuating position.

Abutment end 29 of lever 18 abuts a connecting lever 15, which connecting lever 15 is pivotally mounted on an axle 16 and is spring biased in a counterclockwise direction, as shown by arrow 17, about axle 16. Connecting lever 15 has a groove 14 which contacts a free end 13 of a handle lever 11. Lever 11 is pivotally mounted on an axle 12.

A release lever 8, pivotally mounted on an axle 9, has a free end 10 positioned between an abutment piece 25, part of handle lever 11, and a piston 21. Piston 21 is slideably mounted in an opening in fixed part 4 and is spring biased to the left by a tension spring 22, with tension spring 22 positioned between fixed part 4 and an annular shoulder 26, part of piston 21. Piston 21 biases release lever 8 in a counterclockwise direction causing lever 8 to contact abutment piece 25, thus retaining lever 8 in its cocked position. Connecting arm 15, handle lever 11 and free end 10 comprise a spring retaining means. FIG. 1 illustrates spring 22 in its compressed position.

Release lever 8 is connected to a latching lever 5 by means of a peg 7. Latching lever 5 is slideably mounted in an opening 27 in a fixed part 6 of the safety ski binding. FIG. 1 illustrates latching lever 5 in its latching condition. A leaf spring 23 is attached to release lever 8 and contacts connecting lever 15, biasing lever 15 in a clockwise direction about axle 16 and against the spring force in arrow direction 17. The purpose of spring 23 will be discussed further below. Axles 9, 12, 16 and 24 are all parallel to each other and are fixably mounted to a fixed part (not shown) of the safety ski binding.

When release is appropriate, an electrical impulse is received from the electronic component of a safety ski binding. As described earlier, this impulse energizes an electromagnet in the magnetic release system 1, 2, 3, 20 which reduces or cancels the magnetic field induced by a permanent magnet. Release arm 2 then rotates in a counterclockwise direction under the influence of release spring 3 about an edge 28 of electromagnet 1 to its actuating position (not shown).

Movement of a force amplifier according to this embodiment of the invention from its cocked position (FIG. 1) to its releasing position (FIG. 2) occurs in the following manner. As release arm 2 rotates from its non-actuating to its actuating position, it contacts holding lever 18, urging lever 18 in a counterclockwise direction about axle 24 against the spring force in arrow direction 19. In this manner, abutment piece 29 is moved from a position in which it abuts connection lever 15. Connecting lever 15 then rotates in a counterclockwise direction about axle 16 under the influence of the spring force in arrow direction 17. As it rotates, connecting arm 15 urges free end 13 of handle lever 11 to the left which, in turn, rotates lever 11 in a clockwise direction about axle 12. The rotation of connecting arm 15 also results in its lower portion abutting release arm 2 to urge it against magnet 1 to close the end of magnet 1 against possibly deleterious dirt. This further rotates abutment end 25 of lever 11 to a position in which it no longer abuts free end 10 of release lever 8. Free from the restraint of abutment piece 25, piston 21 and free end 10 are forced to the left under the influence of spring 22, thus rotating release lever 8 in a counterclockwise direction about axle 9.

The rotation of release lever 8 urges latching lever 5 to the left, from its latching position to its unlatching position. With latching lever 5 in its unlatching position, the ski binding is released from its closed condition, in which it holds a ski boot rigidly to the ski, to its open condition in which the ski boot is released from the ski. The positions of all components of a force amplifier according to this preferred embodiment of the invention in its releasing position are illustrated in FIG. 2.

Release arm 2 of the magnetic release system returns to its non-actuating position under the influence of the magnetic field induced by the permanent magnet, for that field is only momentarily diminished or cancelled by the current surge through the electromagnet. Holding lever 18 then returns to its original position under spring influence in spring direction 19. However, when the force amplifier is in its releasing position (FIG. 2), lever 18 does not abut connecting lever 15 which has moved to its release position in which it contacts release arm 2. Free end 10 of release lever 8 rests against fixed part 6 of the safety ski binding.

The return of the above-described force amplifier to its cocked position requires a transition from the position illustrated in FIG. 2 to the position illustrated in FIG. 1. This is accomplished through applying pressure to latching lever 5, urging it to the right. This urges release lever 8 in a clockwise direction and piston 21 to the right, thus compressing spring 22. As lever 8 rotates, leaf spring 23 contacts connecting lever 15 rotating it in a clockwise direction against the spring force in spring direction 17. Free end 13 is moved to the right and abutment end 25 is rotated into a position in which it again abuts free end 10. As lever 15 rotates, it urges lever 18 in a counterclockwise direction. Under spring influence in spring direction 19, lever 18 promptly returns to its holding position when lever 15 has rotated beyond abutment end 29 of lever 18. Abutment end 29 then abuts lever 15 and the force enhancer is returned to its cocked position.

Levers 8, 11, 15 and 18 are preferably formed of sheet metal or other suitable material that provides considerable strength combined with simple construction, such as certain plastics. Latching lever 5 is preferably constructed such that movement of lever 5 to the left results directly in release of the ski binding. This is not illustrated in the drawings, but results in simplification of the binding.

An additional advantage of this construction of a force amplifier according to this invention is that the vector direction of the force by release spring 22 is the same as the vector direction necessary to achieve unlatching of latching lever 5, thus the force of spring 22 is utilized with little loss. Also, a leverage advantage is attained by constructing connecting lever 15 as a two-armed lever with one arm longer than the other arm; the short arm located between axle 16 and handle lever 11 and the long arm positioned between axle 16 and holding lever 18.

Figure 3:
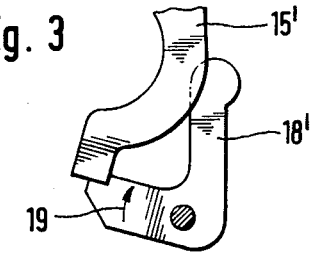
FIG. 3 A modified construction of a force amplifier according to FIG. 1 and FIG. 2.

FIG. 3 illustrates a modified construction of a force amplifier according to FIG. 1 and FIG. 2. In FIG. 3, holding lever 18' replaces holding lever 18 and connecting lever 15' replaces lever 15. Lever 18' is notched so that, when the force amplifier is cocked, lever 18' is retained in its holding position by lever 15' rather than by stop 20.

Considerable force is exerted on the ski binding biasing it towards its open position. This creates a high frictional force on latching lever 5 and the necessity for a relatively high force to counter the frictional force and urge lever 5 to its unlatching position. Spring 22 is capable of exerting this force, while itself being activated by the relatively small force of release arm 2. This is possible because the leveraging arrangement of levers 8, 11 and 15 results in relatively small frictional force between abutment end 29 and connecting lever 15, and it is this smaller frictional force against which release arm 2 must act. The further importance of leaf spring 23 becomes apparent here also, for spring 23 biases connecting lever 15 in a clockwise direction, thus further minimizing the frictional force between abutment end 29 and connecting lever 15. In this manner, the force necessary to rotate lever 18 to its release position is reduced to a point where it is readily activated by movement of release arm 2 to its actuating position.

Through use of force amplifier according to this invention, it is possible to retain the advantages of a small, lightweight magnetic release system, such as the important advantage of minimal energy requirements, while attaining a releasing force sufficient to achieve reliable release of the ski binding. A force amplifier according to this invention may be quite small and lightweight. By constructing and mounting holding lever 18 in such manner that axle 24 is located close to lever 18's center of gravity, optimal safety against faulty release from jarring or shocks is also achieved.

While in its preferred form, release of the mechanism is effected upon the generation of an electrical signal to effect a reduction in the magnetic attraction of arm 2, it is within the scope of the invention to effect release upon the attraction of the arm towards the magnet, with a concomitant variation in the construction of the foregoing mechanism.

This invention has been described in detail with particular emphasis on the preferred embodiments, however it should be understood that there are variations and modifications within the scope and spirit of the invention.

I claim:

1. A release mechanism for safety ski bindings which generate release signals to effect unlatching of the binding, said mechanism being movable between a cocked and a releasing condition, and said mechanism comprising;

release means for releasing a ski binding latching mechanism from a latching to an unlatching condition, said release means including a release lever movable between a cocked position and a releasing position for releasing the binding to the unlatching condition;

biasing means for biasing said release means from a cocked to a releasing position, said biasing means including drive means movable between a cocked position and a releasing position for driving said release lever to the releasing position of said release lever, and spring means for urging said drive means to the releasing position of said drive means, said drive means assuming the releasing position in response to the generation of release signals;

retaining means for retaining said release lever in its cocked position; said retaining means movable between a retaining and a releasing condition;

holding means for holding said retaining means in its retaining condition; said holding means being movable between a holding and a releasing position;

said holding means moving to the releasing position in response to a release signal from the binding, to release said retaining means to its releasing condition enabling said release means to release the latching mechanism.

2. A release mechanism according to claim 1 wherein said retaining means comprises a connecting lever and a handle lever, said handle lever being movable between a cocked position for blocking said release means against releasing the latching mechanism and a releasing position for releasing said release means, and said connecting lever being movable between a cocked position for holding said handle lever in its cocked position and a releasing position for releasing said handle lever, said connecting lever moving from its cocked position to its releasing position in response to movement of said holding means from its holding to its releasing positions.

3. The invention according to claim 2, further comprising means for biasing said connecting lever from its cocked position to its releasing position.

4. The invention according to claim 2 or claim 3, further comprising means for biasing said connecting lever from its releasing position to its cocked position.

5. A release mechanism according to claim 2, wherein said connecting lever is pivotally mounted on an axle and comprising a short arm positioned between said handle lever and said axle and a long arm positioned between said holding lever and said axle.

6. A release mechanism according to claim 2, wherein said biasing means moves said release lever to its releasing position in response to movement of said handle lever to its releasing position.

7. A release mechanism according to claim 6, wherein said release means further comprises a latching lever movable in a linear path in response to movement to said release lever.

8. A release mechanism according to claim 1, wherein said piston is movable in a linear path.

9. A release mechanism according to claim 1, wherein the ski binding comprises an electromagnet for generating signals to effect actuation of the release mechanism to the releasing condition; and wherein said release mechanism comprises a fixed stop associated with the electromagnet, and said holding means comprises a holding lever movable between a holding position for holding said connecting means in its cocked condition, and a releasing position for releasing said connecting means to the releasing condition in response to a release signal from the binding.

10. A release mechanism according to claim 9, further comprising a release arm for moving said holding lever to the releasing position in response to a release signal from the binding.

11. A release mechanism according to claim 1, wherein said holding means comprises a holding lever movable between a holding position for holding said retaining means in its cocked condition, and a releasing position for releasing said connecting means to the releasing condition in response to a release signal from the binding.

* * * * *